United States Patent [19]

Ballmann

[11] 4,249,465

[45] Feb. 10, 1981

[54] PROJECTILE

[76] Inventor: Josef Ballmann, Oberforstbacher Str. 228, D-5100, Aachen, Fed. Rep. of Germany

[21] Appl. No.: 922,773

[22] Filed: Jul. 7, 1978

[30] Foreign Application Priority Data

Jul. 9, 1977 [DE] Fed. Rep. of Germany ..... 2731093

[51] Int. Cl.[3] ..... F42B 5/02; F42B 11/02

[52] U.S. Cl. ..... 102/38 R; 102/93; 102/92.1; 102/DIG. 10; 244/3.23

[58] Field of Search ..... 102/93, DIG. 10, 92.1, 102/38 R; 244/3.1, 3.23

[56] References Cited

U.S. PATENT DOCUMENTS

| | | | |
|---|---|---|---|
| 2,559,955 | 7/1951 | Hartwell | 244/3.23 |
| 3,058,423 | 10/1962 | Laager | 244/3.23 |
| 3,394,905 | 7/1968 | Rapp | 244/3.23 |
| 3,398,682 | 8/1968 | Abela | 244/3.23 |
| 3,419,230 | 12/1968 | Mainhardt | 244/3.23 |
| 3,724,781 | 4/1973 | Makow | 244/3.23 |
| 3,970,004 | 7/1976 | Suter | 244/3.23 |
| 4,063,511 | 12/1977 | Bullard | 244/3.23 |

*Primary Examiner*—Harold J. Tudor
*Attorney, Agent, or Firm*—Finnegan, Henderson, Farabow, Garrett & Dunner

[57] ABSTRACT

In a projectile comprising a projectile body which is surrounded by separable guide means for said body in a barrel and/or has a separable propulsion member disposed between it and a propellant container, spin-producing passages adapted to be penetrated by propellant gas are provided in said guide means and/or said propulsion member.

14 Claims, 24 Drawing Figures

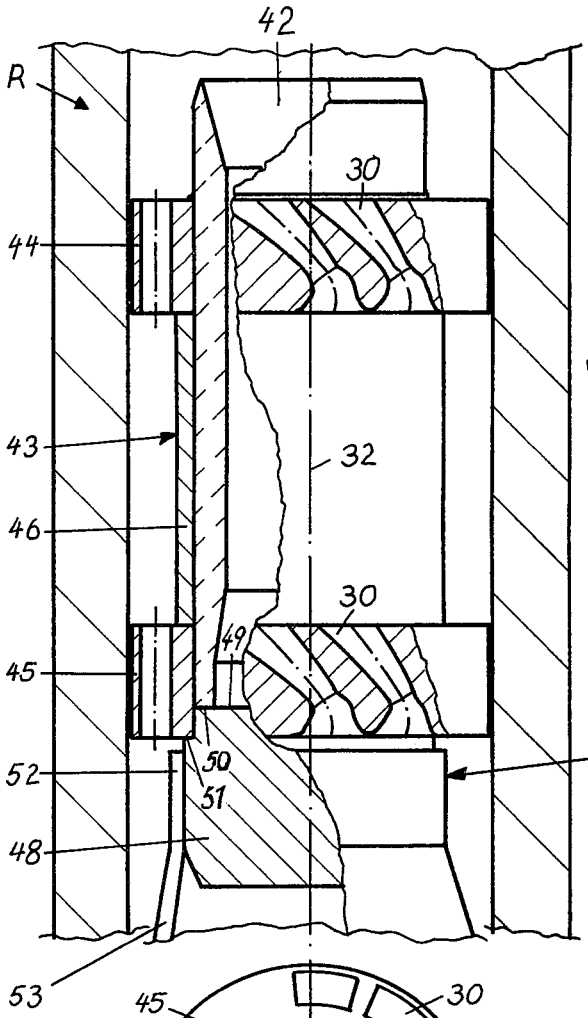
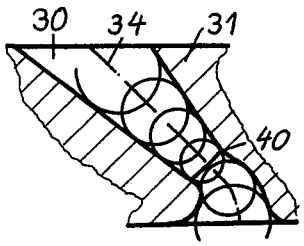
Fig. 15
Fig. 16
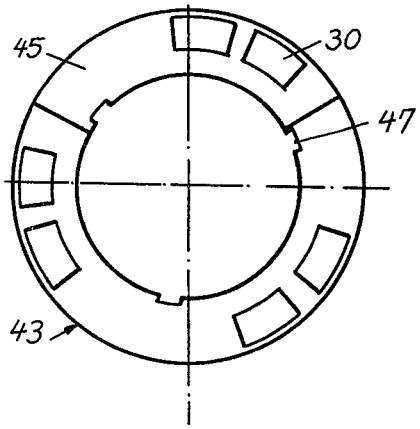
Fig. 17

PROJECTILE

BACKGROUND OF THE INVENTION

The invention relates to a projectile, particularly for shooting from a smooth barrel, comprising guide members and/or a propulsion member, which separate from the projectile body after leaving the barrel.

The projectile according to the invention can be one having a sub-calibre solid projectile body or a calibred or sub-calibre tubular projectile body. Further, it may be with or without steering gear.

In so far that the projectile according to the invention comprises guide members, these can be of the known kind consisting of a cage or of rings by which the body of the projectile is surrounded with a positive fit. The cage as well as the rings will in that case preferably comprise a plurality of releasably interconnected segments or segments that are merely interconnected by frangible portions. The propulsion member of the projectile is as usual disposed between the front end of the propellant container and the rear of the projectile body without being permanently connected to the latter. It may be of one or more parts. Further, it is possible to combine it with the guide members to form a unit.

Projectiles of the kind in question are not only provided for sharp shooting but they are also used to a large extent as so called training projectiles for target practise.

It is desirable to propel such projectiles with a spin, the extent of spinning being adapted to the departure and flight properties of a particular type of projectile, and to obtain spinning even when shot from a smooth barrel.

In the case of aerodynamically unstable projectiles, spinning is particularly desirable for obtaining flight stability of the projectile. The rotary speed about the longitudinal axis of the projectile, also termed trajectory flatness, is given by the shape and mass geometry of the projectile body when released from its guide members and its propulsion member. At the same time, spinning favours the trouble-free separation of laterally flung guide members after the projectile leaves the barrel.

It is known that projectiles of the stated kind can have a spin imparted to them in the barrel by providing the latter with so-called rifling. In this case the projectile has an excess dimension on at least part of its peripheral surface, so that, upon firing, it is first pressed into the rifling and then follows the rifling almost with a positive fit. With this method of producing the spin, the extent of spinning on departure is given by the angle of the rifling in the barrel and the muzzle velocity of the projectile. This fact makes any kind of spin control impossible if one wants to fire different projectile shapes from one end and the same barrel or obtain different muzzle velocities, as is desired in the case of target practise and may also be desirable for sharp shooting. As a result, one obtains defective flight and target behaviour of the projectile body.

However, projectile shapes have also become known wherein the projectile is made in one piece and is provided on its outer wall or in the interior with so-called spin passages. On firing, these passages are penetrated by the propellant gases and they permit projectiles to be shot from smooth barrels with a spin. By appropriately shaping the passages, they also permit selection of the trajectory flatness independently of the muzzle velocity of the projectile. However, the projectile constructions in question have not proved successful because of their external ballistic problems and because of an unfavourable shape of their spin passages.

Smooth barrels are currently used only to shoot projectiles having guide members and/or a propulsion member; they leave the barrel without spin and are equipped with steering gear for stabilising their flight. An inherent risk of steering gear is that the projectile body is not separated from the guide members without any impact. In addition, steering gear makes the projectile supersensitive to the powder gas impinging on the rear of the projectile during departure. Steering gear that falls open has the inherent additional danger of malfunctioning. These constructions of projectiles are not only liable to become defective but also expensive to produce and therefore not very suitable for practising purposes.

SUMMARY OF THE INVENTION

The invention is based on the problem of constructing a projectile of the aforementioned kind with guide members and/or a propulsion member so that it can be propelled with a spin of which the trajectory flatness is selectable independently of the muzzle velocity. In the case of a projectile without steering gear, the spin should above all produce stabilisation of the projectile body and a flight adapted to ballistic requirements, whereas in the case of a projectile with steering gear the aim is primarily to facilitate separation of the guide members from the projectile body without collision.

This problem is solved according to the invention in that the guide members and/or the propulsion member of such a projectile are provided with spin-producing flow passages.

These spin-producing flow passages, hereinafter referred to as spin passages, are penetrated by the propellant gas during firing of the projectile and then produce the desired spin. By suitably constructing and arranging the spin passages, one can achieve a trajectory flatness that is correct for a particular shape of projectile and muzzle velocity. Since the spin passages are disposed in the guide members and/or the propulsion member, they in no way influence the flight of the projectile body.

When producing the spin in accordance with the invention, the gas flowing through the spin passages has a change in spin about the barrel axis imposed on it by the boundaries of the spin passages, i.e. a change in its flow velocity in the direction of the periphery. To achieve a good effectiveness of the spin passages, they are constructed and arranged so that the spinning flow is obstructed as little as possible by parts of the projectile. Since the projectile body does not completely fill out the barrel cross-section, this can be readily achieved.

To avoid large losses of propellant gas, the cross-sections of the spin passages are according to the invention kept as small as possible at the narrowest positions and the outlet orifices of the passages are arranged so that the axis of the gas jet has the largest possible spacing from the projectile axis and the gas jet possesses a peripheral speed component which is as large as possible.

The invention makes provision for various embodiments for the construction and arrangement of the spin passages.

Thus, the spin passages may have a constant cross-section throughout their length, which is particularly cheap from a manufacturing point of view. Further, they may have a cross-section which continuously or discontinuously converges in the direction of flow. Further, it is possible that their cross-sections have a constriction and that they continuously or discontinuously diverge downstream of same.

The last-mentioned embodiment of the spin passages is of advantage in those cases where the pressure drop between the inlet and outlet cross-sections of the passages is sufficient to form supersonic flow. This is always achievable with conventional gas propellant pressure behaviour in a barrel and permits an increased spinning effect.

In a further embodiment, provision is made for the pressure side of the bounding wall of the spin passages at the outlet end to have an extension. This extension gives the propellant gas a velocity component in the peripheral direction of the barrel.

In the described embodiments of the spin passages, each may have a rectilinear axis oblique to the projectile axis at a constant or only slightly varying spacing therefrom. However, they may also have an axis which is continuously or discontinuously curved over at least part of the passage length and extends at a constant or only slightly varying spacing from the projectile axis. In both cases, the spin passages constitute axial passages.

However, according to the invention it is also possible that in the described embodiments of the spin passages their axes have a widely varying spacing from the projectile axis between their inlet and outlet ends and are designed to be penetrated by flow from the inside to the outside, or conversely. These spin passages may possibly be radial passages.

Bringing about spinning by means of a few of the stated passage shapes and arrangements is physically based on the expansion of the propellant gas in the passages and its consequent acceleration and change of rotary movement about the barrel axis. In the case of different passage shapes and arrangements, the creation of spinning is caused exclusively or additionally by a change in the flow direction of the propellant gas through deviation.

According to the invention it is also possible for the spin passages to have a combined construction, for example a continuously or discontinuously curved axis and cross-sections with a constriction and an adjoining downstream enlargement. Such combinations permit the spin to be produced partly by expansion of the propellant gas and partly by diversion of its flow in the passages. They are therefore characterised by a correspondingly increased effectiveness but their manufacture is somewhat more expensive than simple passage shapes and arrangements.

The projectile according to the invention can further make provision for spin passages which annularly surround the projectile axis and form an axial group of passages. Further, the projectile according to the invention may have spin passages arranged so that they surround the projectile axis in wreath fashion and form a radial group of passages. Finally, it is also possible in the projectile according to the invention that two or more spaced and successively penetrated passage groups are provided for dual or multi-stage spin production.

The construction of the projectile with two or more spaced and successively penetrated passage groups for dual or multi-stage spin production is particularly effective. In this construction, it is also very advantageous to provide at least the first group of passages with passages containing a constriction and an adjoining downstream enlargement, because in this construction the highest degree of stage effect can be achieved.

After the propellant gas has left a group of passages and before entering the next group of passages, it is braked under friction at the bounding walls between the groups of passages and, if the gas has supersonic speed, by a system of compression shocks and compression waves from supersonic to subsonic speed. The pressure that is recovered in this way is again available for producing spin during the next stage.

Braking of the propellant gas between the groups of passages is associated with an increase in entropy caused by the compression shocks and by friction. This reduces the maximum possible flow of mass referred to the penetrated area, i.e. the so-called critical flow density. If the critical flow density is achieved in a passage, it always occurs in close proximity to the narrowest portion of the passage. This also applies to a group of passages or to a spin production stage where the so-called narrowest cross-section of the stage corresponds to the narrowest total flow cross-section of all spin passages of the stage including all leakage gaps.

The critical flow density which decreases in the direction of flow as described is, according to the invention taken into account in such constructions of the projectile by the feature that the narrowest total cross-section of a group of passages formed by the cross-sections of the individual passages in a group increases downstream from one group of passages to the next. The increase should be such that one obtains the highest possible spin effect referred to the quantity of gas used to produce spinning.

In one embodiment, the increase in total cross-section of a group of passages is achieved in that the individual passages of a following group have a larger cross-section than the individual passages of a group disposed in front of that group. In another embodiment, with the same cross-section of the individual passages of all groups a following group has more passages than a group in front of that group.

To achieve the same result in a different manner, the invention further provides that, with the same narrowest total cross-section of the group of passages formed by the cross-sections of the individual passages, the groups of passages are provided with leakage gaps that increase downstream from one group of passages to the next.

The quantity of gas used to produce spinning of the projectile according to the invention can be kept small as a whole by the stated construction and arrangement of the spin passages, spin passage groups and spin production stages. As a loss of propellant gas, it therefore has only a small influence on the muzzle velocity of the projectile, especially since there are no additional frictional force components as those occurring between the projectile wall and the barrel wall when spinning is produced with the aid of rifling.

However, it is important that during ignition and principal combustion of the propellant a high pressure is able to build up behind the projectile because this considerably enhances combustion of the propellant. To make this possible, the projectile according to the invention can have the provision that the rear portion of the projectile body or propulsion member and the aperture of the propellant container be constructed such that the spin passages are disposed beyond the confines of the container aperture and the rear portion of the projectile body or propulsion member projects into the container aperture. The result of such a construction is that the spin passages can be reached by the propellant gas only after the projectile has already travelled a short distance within the barrel, substantially equal to the length of one calibre.

Although the projectile according to the invention has also been developed particularly for shooting from a smooth barrel, it is nevertheless suitable for shooting from a rifled barrel. For such applications of the projectile, the invention also provides for its projectile body or its guide members and its propulsion member to have such a smaller dimension that its spin is not governed by the rifling of the barrel.

The invention as well as various embodiments of the projectile according to the invention are illustrated by way of example in the drawings, wherein:

BRIEF DESCRIPTION OF THE DRAWINGS

FIG. 15 is a diagrammatic cross-section of a spin passage penetrated by the propellant gas;

FIG. 16 is a fragmentary part-sectional plan view of a sub-calibre barrel projectile disposed in a barrel;

FIG. 17 is an end elevation of the guide members of the FIG. 16 projectile;

DESCRIPTION OF THE PREFERRED EMBODIMENT

Figure 1:
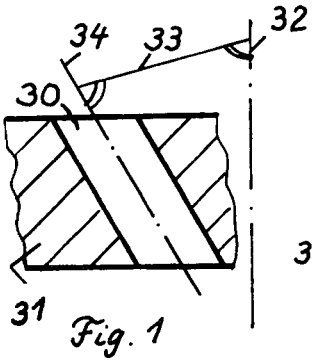
FIGS. 1 to 14 show a series of embodiments of spin passages in diagrammatic cross-section.
Figure 2:
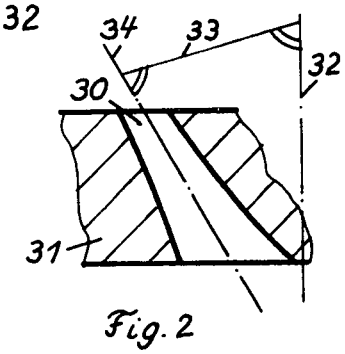
Figure 3:
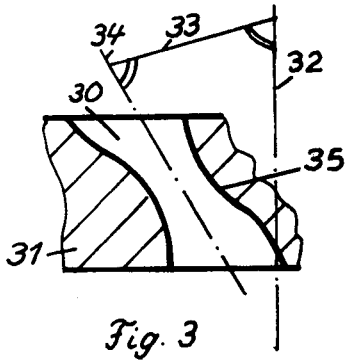
Figure 4:
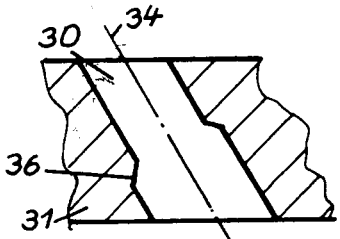
Figure 5:
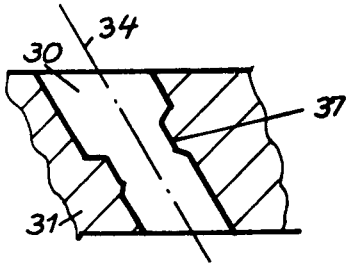

Spin passages of the kind shown in FIGS. 1 to 15 can be provided in the guide members and/or the propulsion member.

In the stated Figures, the spin passages are all designated 30 whereas the guide members or the propulsion member in which they are located bear the reference numeral 31. In order to illustrate the position of the spin passages 30 in relation to the axis of the projectile, the projectile axis is indicated by the chain-dotted line 32 in FIGS. 1 to 3 and 6 to 8. Further, the axis of the spin passages is in each case designated 34. The line 33 signifies the spacing between the spin passages axis 34 and the projectile axis 32.

The spin passages 30 shown in FIGS. 1 to 5 have the common feature of a rectilinear axis 34 which extends at an only slightly differing spacing obliquely to the projectile axis 32. However, the cross-sections of the spin passages shown in these Figures are different. Thus, the spin passage in FIG. 1 has a constant cross-section throughout its length whereas the cross-section of the FIG. 2 spin passage converges. In the spin passage of FIG. 3, it converges to form a constriction 35 and then diverges again. The spin passage of FIG. 4 has a first section of larger diameter as well as a second section of smaller diameter, the sections being interconnected by a conical transition zone 36. The spin passage of FIG. 5 has a central constricting section 37 which adjoins a first section and is followed by a further section with a cross-section larger than that of the first section.

Figure 6:
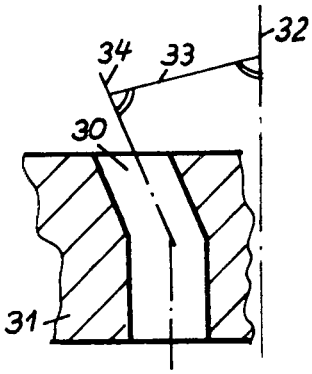
Figure 7:
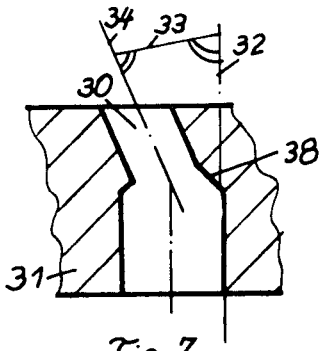
Figure 8:
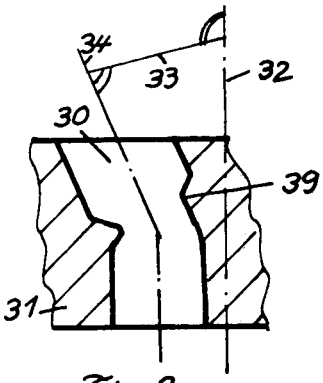

In the spin passages 30 of FIGS. 6 to 8, their axis 34 is cranked. Cranking of the axis 34 is in each case obtained in that the spin passages have a first portion extending parallel to the projectile axis 32 and a second portion oblique to the projectile axis 32. In the spin passage of FIG. 6, its first and second portions have the same cross-section. The spin passage of FIG. 7 has a first portion of larger cross-section and a second portion of smaller cross-section with a substantially conical transition zone 38. In contrast, in the spin passage of FIG. 8 the second portion has a larger diameter than the first portion and between these two portions there is a constriction zone 39 of smaller diameter.

Figure 9:
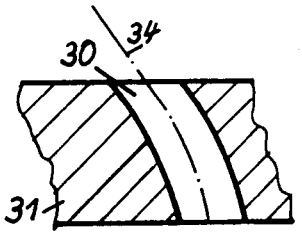
Figure 10:
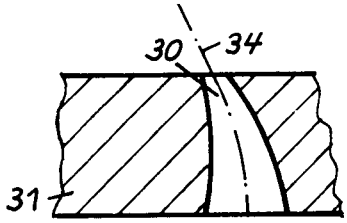
Figure 11:
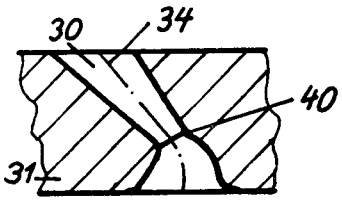

The common feature of the spin passages 30 of FIGS. 9 to 11 is that their axis is curved. However, their cross-sections are also different. Thus, the spin passage of FIG. 9 is of constant cross-section throughout its entire length. In contrast, the cross-section of the spin passage in FIG. 10 converges. In the spin passage of FIG. 11 there is a first portion of converging cross-section and a second portion of diverging cross-section and the transition zone 40 between these portions forms a constriction.

Figure 12:
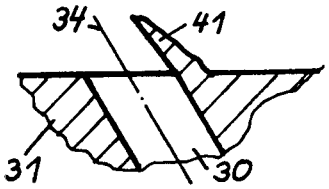
Figure 13:
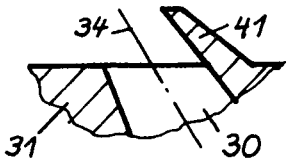
Figure 14:
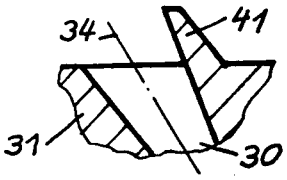

The spin passages of FIGS. 12 to 14 have the peculiar feature that the pressure side of their bounding wall has an extension at the outlet end.

The construction of the spin passage 30 in FIG. 15 corresponds to that of the spin passage in FIG. 11. The circles depicted in FIG. 15 show how the propellant gas penetrating the spin passage is expanded to sonic speed in the converging first portion thereof up to the constriction 40 and then further accelerated to supersonic speed in its second portion. Further, this Figure shows how the propellant gas is diverted in the spin passage.

In FIGS. 16, 18, 21, 23 and 25, which show projectiles disposed in barrels, the barrel is in each case designated R and the projectile therein is indicated as a whole by the reference G.

In the FIG. 16 embodiment, the projectile G contains a sub-calibre tubular projectile body 42. Surrounding the projectile body 42 with a complementary shape there is a guide cage 43. The guide cage 43 comprises a leading guide ring 44 disposed near the front end of the projectile body 42, a trailing guide ring 45 provided at the rear end of the projectile body 42 and a hollow cylindrical spacer 46 between them. The outer diameter of the guide rings 44, 45 corresponds to the calibre of the barrel R whereas the outer diameter of the spacer 46 is much smaller.

The rings 44 and 45 as well as the spacer 46 of the guide cage 43 are composed of three longitudinal segments which are merely interconnected by frangible portions. Each segment forms one section of the guide rings 44, 45 as well as of the spacer 46. For the purpose of the positive complementary arrangement of the guide cage 43 about the projectile body 42, its segments are provided with longitudinal grooves 47. The projectile body 42 has similar longitudinal grooves (not shown). With the aid of keys (also not shown) which fit into the longitudinal grooves one obtains a positive connection between the guide cage 43 and the projectile body 42.

Spin passages 30 are provided in the guide ring 44 as well as in the guide ring 45. The spin passages 30 have a form corresponding to that shown in FIGS. 11 and 15. The spin passages 30 of the guide ring 45 form a first group of axial passages and the spin passages 30 of the guide ring 44 form a second group of axial passages. A two-stage production of spinning is therefore formed by the groups of passages as a result of being penetrated by the propellant gas.

A propulsion member 48 is provided adjoining the rear end of the projectile body 42. This propulsion member 48 has its front wall 49 lying against the end wall 50 of the projectile body 42. At its front end the propulsion member 48 has an annular outer shoulder 51. With the aid of this shoulder 51 it also abuts the rear end of the guide ring 45.

The rear end of the propulsion member 48 projects into the aperture 52 of the propellant container 53 of the projectile by a distance equal to about half the projectile calibre. The propulsion member 48 as well as the aperture 52 of the propellant container 53 have such a small diameter that the spin passages 30 of the guide ring 45 are disposed beyond the confines thereof.

Figure 18:
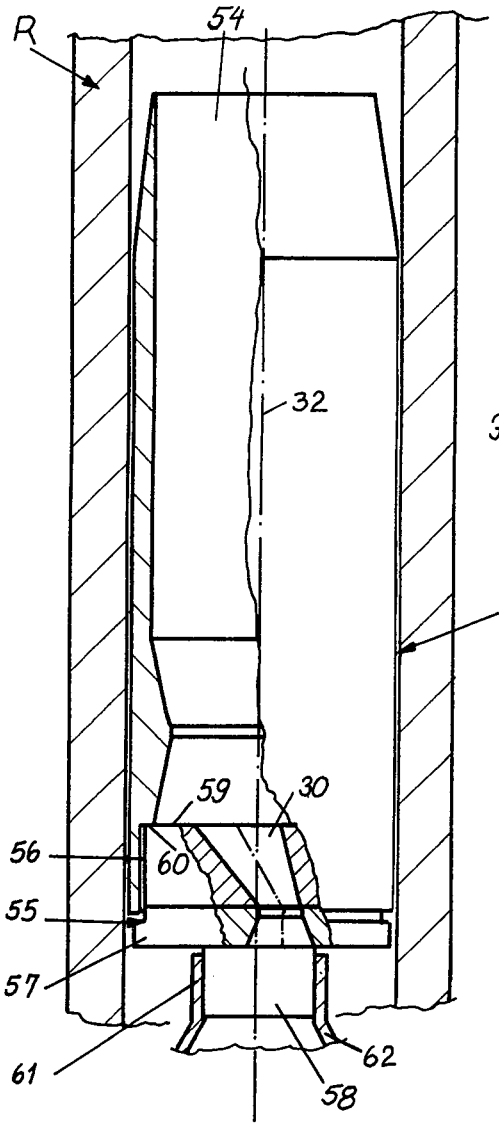
FIG. 18 is a fragmentary part-sectional plan view of a calibred barrel projectile disposed in a barrel.

The projectile G shown in FIG. 18 is one having a calibred tubular projectile body 54. Since the projectile body 54 is calibred, it does not require guide members. However, the rear end of the projectile body 54 is provided with a propulsion member 55.

The propulsion member 55 has a front portion 56, a central portion 57 and a rear portion 58. The front portion 56 fits into the rear end of the projectile body 54 and its front face 59 abuts an annular shoulder 60 of the inner face of the projectile body 54. The central portion 57 of the propulsion member 55 has a somewhat larger diameter than its front portion 56 and consequently also projects somewhat beyond the inner edge of the rear end of the projectile body 54. The rear portion 58 of the propulsion member 55, however, has a much smaller diameter in relation to its two other portions 56, 57 and extends into the aperture 61 of the propellant container 62 of the projectile.

Figure 20:
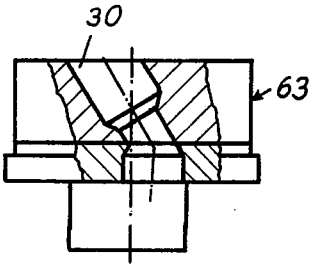
FIG. 20 is a part-sectional plan view of the propulsion member of the FIG. 18 projectile with a different construction for its spin passages.
Figure 19:
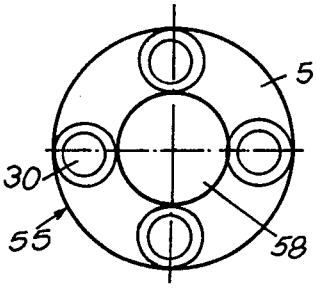
FIG. 19 is an end elevation of the propulsion member of the FIG. 18 projectile.

Spin passages 30 are provided in the central portion 57 as well as the front portion 56 of the propulsion member 55. These spin passages have a construction somewhat like those of the spin passages of FIGS. 11 and 15. Each first section of the spin passages is disposed in the central portion 57 of the propulsion member 55 and the second section of the spin passages is disposed in the front portion 56 thereof. The diameter of the rear portion 58 of the propulsion member 55 as well as of the aperture 61 of the propellant container 62 are here likewise so small that the spin passages 30 are disposed beyond the confines thereof. Instead of the propulsion member 55, the projectile G of FIG. 18 can also make use of the propulsion member 63 of FIG. 20. This propulsion member differs from the propulsion member 55 in that its spin passages 30 have a somewhat different construction. The construction of the spin passages corresponds somewhat to the spin passage shown in FIG. 8.

Figure 21:
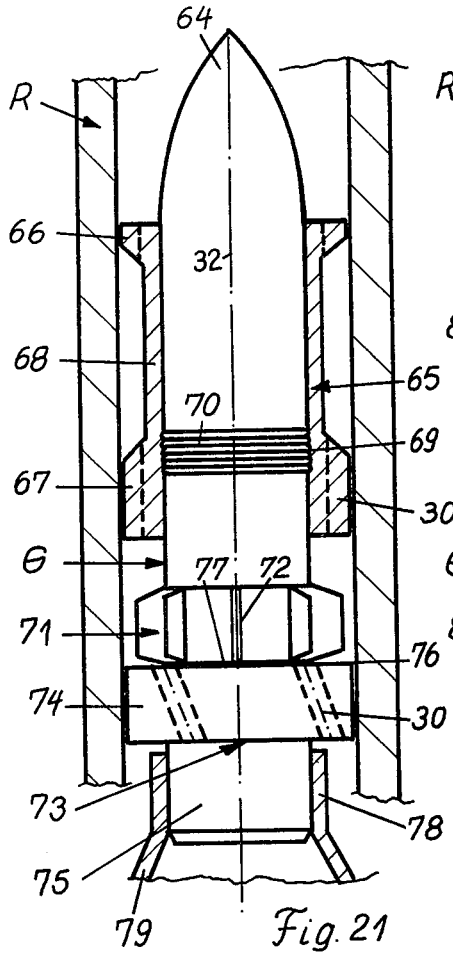
FIG. 21 is a fragmentary part-sectional plan view of a sub-calibre solid projectile with steering gear disposed in a barrel.

The projectile G shown in FIG. 21 has a sub-calibred solid projectile body 64. The solid projectile body 64 is surrounded with a positive driving fit at its central region by a guide cage 65 having a front guide ring 66, a rear guide ring 67 and a hollow cylindrical spacer 68 between same. The positive connection between the guide cage 65 and the projectile body 64 is brought about in that the guide cage 65 is screwed with the aid of an internal thread 69 onto the corresponding external screwthread 70 of the projectile body 64.

Figure 23:
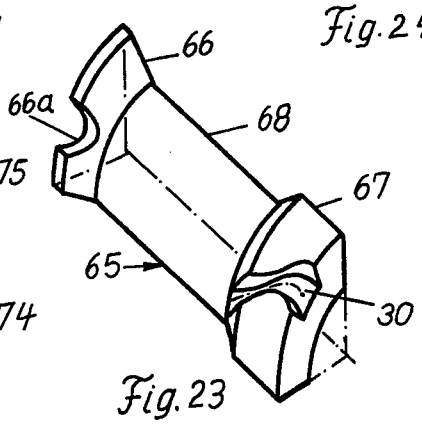
FIG. 23 is a pictorial view of one segment of the guide cage of the FIG. 21 projectile.

The guide cage 65 is composed of longitudinal segments, each forming a section of the front guide ring 66, the spacer 68 and the rear guide ring 67. The longitudinal segments are interconnected by frangible portions. One of these segments is illustrated in FIG. 23.

The rear guide ring 67 is equipped with spin passages 30. The spin passages 30 have a shape substantially corresponding to the shape of the spin passages 30 in FIGS. 11 and 15. However, the spin passages 30 are here open towards the peripheral face of the ring 67. The front ring 66 of the cage 65 also contains orifices **66*a* which are open towards the edge and permit the throughflow towards the muzzle end of the barrel of propellant gas that has penetrated the spin passages 30**.

The rear end of the projectile body 64 is equipped with steering gear 71. This steering gear 71 is formed by spaced vanes 72 extending radially outwardly from the periphery of the projectile body 64.

Adjoining the rear end of the projectile body 64 there is a propulsion member 73 having a leading portion 74 and a trailing portion 75. The leading portion 74 of the propulsion member 73 has an outer diameter corresponding to the internal diameter of the barrel R and its front face 76 abuts the rear face 77 of the projectile body 64. The trailing portion 75 of the propulsion member 73 has a much smaller diameter and projects into the aperture 78 of the propellant container 79 of the projectile.

The leading portion 74 of the propulsion member 73 is equipped with spin passages 30. The spin passages 30 have a construction corresponding to the spin passage 30 in FIG. 1. The diameter of the trailing portion 75 of the propulsion member 73 as well as of the aperture 78 of the propellant container 79 are selected so that the spin passages 30 are disposed beyond the confines thereof.

Figure 24:
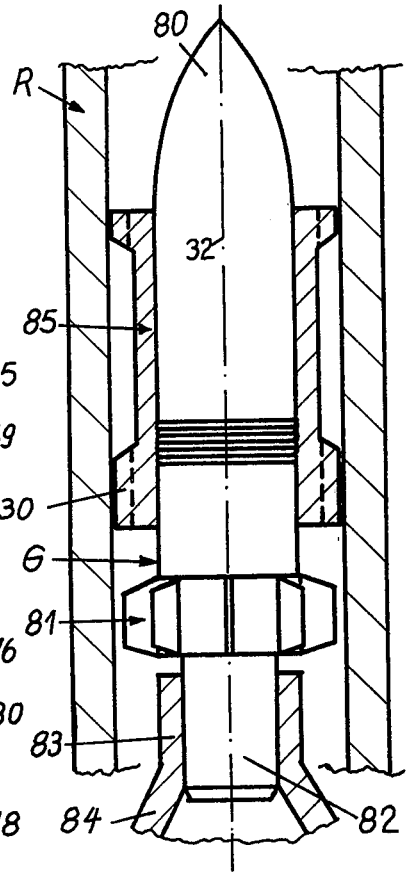
FIG. 24 is a fragmentary part-sectional plan view of a further sub-callibre solid projectile with steering gear disposed in a barrel.
Figure 22:
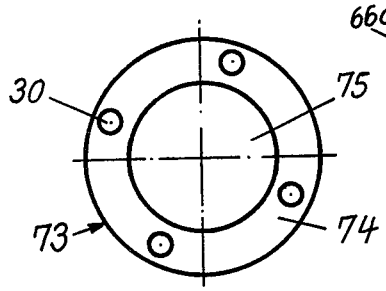
FIG. 22 is an end elevation of the propulsion member of the FIG. 21 projectile.

The projectile body 80 of the projectile G shown in FIG. 24 somewhat resembles the projectile body 64 of the projectile G in FIG. 21. The same applies to the cage 85 which surrounds the projectile body 80. The difference is that the cage 85 of the projectile in question serves as a guide cage as well as a propulsion member.

At its rear end, adjoining its steering gear 81, the projectile body 80 has a cylindrical extension 82 of somewhat smaller diameter. This extension extends into the aperture 83 of the propellant container 84 of the projectile.

In so far that the illustrated projectiles have a propulsion member adjoining the rear end of their projectile body, means are also provided for connecting the propulsion member to the projectile body. Said means enable the parts to be held together before the projectile is shot but, upon expulsion of the projectile body from the barrel, they permit ready separation of the propulsion member from the projectile body under the action of air resistance.

I claim:

1. A projectile for shooting from a gun barrel in response to a force emanating from the aperture of a propellant container, comprising:

(a) a tubular projectile body; and (b) a propulsion member situated between the rear end of the projectile body and the propellant container and comprising a front portion extending into the rear end of the projectile body and adapted to separate from the projectile body upon exiting the barrel and a rear portion extending into the aperture of the propellant container, wherein the front portion of the propulsion member is of larger diameter than the aperture of the propellant container and the rear portion of the propulsion member, and wherein the front portion of the propulsion member is provided with a plurality of axial, spin-producing flow passages extending therethrough and annularly surrounding the longitudinal axis of the projectile body, with the openings of said passages lying nearest the propellant container aperture being situated outside of the area defined by the aperture.

2. A projectile according to claim 1, wherein each of the flow passages includes a constricted portion, with the passage diverging downstream of the constricted portion.

3. A projectile according to claim 1, wherein the axis of each of the flow passages extends obliquely to the longitudinal axis of the projectile body and the distance between said two axes is substantially constant over the length of the flow passages.

4. A projectile according to claim 1, wherein the axis of each of the flow passages is curved over at least a portion of its length.

5. A projectile according to claim 1, wherein the propulsion member further comprises a central portion situated between the front and rear portions and having a larger diameter than the front portion, wherein the flow passages are extended through the central portion.

6. A projectile according to claim 5, wherein the end of the projectile body adjacent the propulsion member includes inner and outer edge portions, and wherein the central portion of the propulsion member projects radially beyond the inner edge portion.

7. A projectile according to claim 6, wherein each of the flow passages includes a constricted portion situated in the transition region between the central and front portions of the propulsion member, with the passage diverging downstream of the constricted portion.

8. A projectile for shooting from a gun barrel in response to a force emanating from the aperture of a propellant container, comprising:

(a) a sub-caliber tubular projectile body;

(b) a guide cage surrounding the projectile body and having a shape complementary thereto, said cage having a leading guide ring situated near the front end of the projectile body, a trailing guide ring situated near the rear end of the projectile body, and a cylindrical spacer between the leading and trailing guide rings, wherein each of the rings of the guide cage is provided with a plurality of axial, spin-producing flow passages annularly surrounding the longitudinal axis of the projectile body; and (c) a propulsion member situated between the rear end of the projectile body and the propellant container and comprising a front portion situated adjacent the rear end of the projectile body and a rear portion extending into the aperture of the propellant container, wherein a portion of the trailing guide ring extends beyond the rear end of the projectile body, and wherein the front portion of the propulsion member includes a shoulder adapted to abut the extending portion of the trailing guide ring, and wherein the openings of the flow passages lying nearest the propellant container aperture are situated outside of the area defined by the aperture and the area defined by the rear portion of the propulsion member, and wherein the guide cage and the propulsion member are adapted to separate from the projectile body upon exiting the barrel.

9. A projectile according to claim 8, wherein the guide rings and the spacer are each comprised of three longitudinal segments interconnected by frangible elements.

10. A projectile according to claim 8, wherein each of the flow passages includes a constricted portion, with the passage diverging downstream of the constricted portion.

11. A projectile according to claim 8, wherein the axis of each of the flow passages extends obliquely to the longitudinal axis of the projectile body and the distance between said two axes is substantially constant over the length of the flow passages.

12. A projectile according to claim 8, wherein the axis of each of the flow passages is curved over at least a portion of its length.

13. A projectile according to claim 8, wherein the total cross-sectional area of the flow passages in the leading guide ring is greater than the total cross-sectional area of the flow passages in the trailing guide ring.

14. A projectile according to claim 1, or 8, wherein the length to which the rear portion of the propulsion member extending into the aperture of the propellant container is substantially equal to the caliber of the barrel.

* * * * *